US010000958B2

(12) United States Patent
Evans

(10) Patent No.: US 10,000,958 B2
(45) Date of Patent: Jun. 19, 2018

(54) INTELLIGENT SENSING EDGE AND CONTROL SYSTEM

(71) Applicant: Rob J. Evans, Glendale, AZ (US)

(72) Inventor: Rob J. Evans, Glendale, AZ (US)

( * ) Notice: Subject to any disclaimer, the term of this patent is extended or adjusted under 35 U.S.C. 154(b) by 0 days. days.

(21) Appl. No.: 15/188,935

(22) Filed: Jun. 21, 2016

(65) Prior Publication Data

US 2017/0314313 A1 Nov. 2, 2017

Related U.S. Application Data

(60) Provisional application No. 62/330,791, filed on May 2, 2016.

(51) Int. Cl.

| | |
|---|---|
| ***E05F 15/42*** | (2015.01) |
| ***E05F 15/72*** | (2015.01) |
| ***E06B 9/68*** | (2006.01) |
| ***E06B 9/88*** | (2006.01) |

(52) U.S. Cl.

CPC ..... *E05F 15/42* (2015.01); *E05F 15/72* (2015.01); *E06B 9/68* (2013.01); *E06B 9/88* (2013.01); *E05Y 2400/32* (2013.01); *E05Y 2400/44* (2013.01); *E05Y 2400/52* (2013.01); *E05Y 2900/106* (2013.01); *E05Y 2900/134* (2013.01); *E06B 2009/6836* (2013.01); *E06B 2009/885* (2013.01)

(58) Field of Classification Search

None

See application file for complete search history.

(56) References Cited

U.S. PATENT DOCUMENTS

| | | | | |
|---|---|---|---|---|
| 4,318,079 | A * | 3/1982 | Dickinson | E01F 13/06 116/52 |
| 4,785,143 | A | 11/1988 | Miller | |
| 5,072,079 | A | 12/1991 | Miller | |
| 5,384,982 | A * | 1/1995 | Galperin | F16P 3/12 200/61.43 |
| 5,695,859 | A | 12/1997 | Burgess | |
| 5,839,227 | A | 11/1998 | Gardner | |
| 5,856,644 | A | 1/1999 | Burgess | |
| 6,049,287 | A * | 4/2000 | Yulkowski | A62C 2/24 292/251.5 |
| 6,199,321 | B1 * | 3/2001 | Ginzel | E05F 3/227 49/27 |
| 6,225,768 | B1 | 5/2001 | Cookson et al. | |
| 6,286,257 | B1 | 9/2001 | Gregoriou et al. | |
| 6,329,617 | B1 | 12/2001 | Burgess | |
| 6,396,010 | B1 | 5/2002 | Woodward et al. | |
| 6,427,382 | B2 | 8/2002 | Gregoriou et al. | |

(Continued)

OTHER PUBLICATIONS

"Reversing 'Soft' Fail-Safety Edge," accessed on Apr. 18, 2016 from http://www.international-door.com/safety-edges.php.

*Primary Examiner* — Marcus Menezes

(74) *Attorney, Agent, or Firm* — Morgan Law Offices, PLC

(57) ABSTRACT

A sensing edge is made in segments that can be used to determine at which point along the edge an obstruction occurred. Data collected can be used to determine a point in a process that the fault occurred by addressing each segment individually or as a whole. A programmable controller can be operatively coupled to the sensing edge, and can include logic to control the door and/or other equipment using data collected from the sensing edge.

7 Claims, 3 Drawing Sheets

(56) References Cited

U.S. PATENT DOCUMENTS

| | | | | |
|---|---|---|---|---|
| 6,689,970 | B2 * | 2/2004 | Burgess | H01H 3/142 200/61.43 |
| 8,049,451 | B2 * | 11/2011 | Patterson | G01V 3/088 318/264 |
| 8,421,482 | B2 * | 4/2013 | Wuerstlein | H03K 17/955 318/662 |
| 8,635,809 | B2 * | 1/2014 | Wuerstlein | H03K 17/955 296/146.9 |
| 9,644,424 | B2 * | 5/2017 | Slivka | E06B 9/72 |
| 2003/0085679 | A1 * | 5/2003 | Bledin | E05F 15/46 318/264 |
| 2004/0183677 | A1 * | 9/2004 | Fitzgibbon | E05F 15/72 340/540 |
| 2010/0024301 | A1 * | 2/2010 | Wuerstlein | E05F 15/46 49/28 |
| 2010/0050787 | A1 * | 3/2010 | Abert | H03K 17/955 73/862.626 |
| 2010/0287837 | A1 * | 11/2010 | Wuerstlein | E05F 15/46 49/26 |
| 2017/0030128 | A1 * | 2/2017 | Elie | E05F 15/42 |

* cited by examiner

INTELLIGENT SENSING EDGE AND CONTROL SYSTEM

CROSS-REFERENCE TO RELATED APPLICATIONS

This application claims the benefit of provisional Ser. No. 62/330,791, filed May 2, 2016, entitled "INTELLIGENT SENSING EDGE FOR MOTORIZED DOOR" to Rob J. Evans, the subject matter of which is incorporated herein by reference.

BACKGROUND OF THE INVENTION

1. Field of the Invention

The present invention relates to motorized doors, and, more particularly to an intelligent sensing edge and control system for a motorized door.

2. Description of the Related Art

Motorized doors have many industrial and commercial uses. However, care must be taken when operating a motorized door. When a motorized door encounters a significant obstruction during closing, for instance, it may be necessary to immediately reverse the motor direction or halt the operation of the door.

The prior art is replete with safety devices for motorized door systems, such as various types of safety edges. When a door is equipped with a safety edge, a signal is typically sent to halt or reverse the motor when the edge encounters an obstruction. In other cases, a signal is interrupted, and the absence of the signal then triggers the control system to take appropriate action.

In the prior art, pneumatic air activated systems include an edge having a flexible hose that is sealed. When encountering an obstruction, the hose is compressed causing the air in the hose to push against a switch, sending a signal to a control system. While such systems are useful, they often suffer from reliability and maintenance problems.

In the prior art, electric-activated edges are more widely employed. Typically, these devices include dual conductive strips that are separated by an air gap. When encountering an obstruction, the conductive strips are pushed together completing a circuit, thereby causing a signal to be sent to the control system.

Although such prior art safety edges are very useful, they suffer from the fact that they cannot provide any information other than the fact that the door has encountered an obstruction.

SUMMARY OF THE INVENTION

A sensing edge is made in segments that can be used to determine at which point along the edge an obstruction occurred. Data collected can be used to determine a point in a process that the fault occurred by addressing each segment individually or as a whole. A programmable controller can be operatively coupled to the sensing edge, and can include logic to control the door and/or other equipment using data collected from the sensing edge.

DETAILED DESCRIPTION OF THE INVENTION

Figure 1:
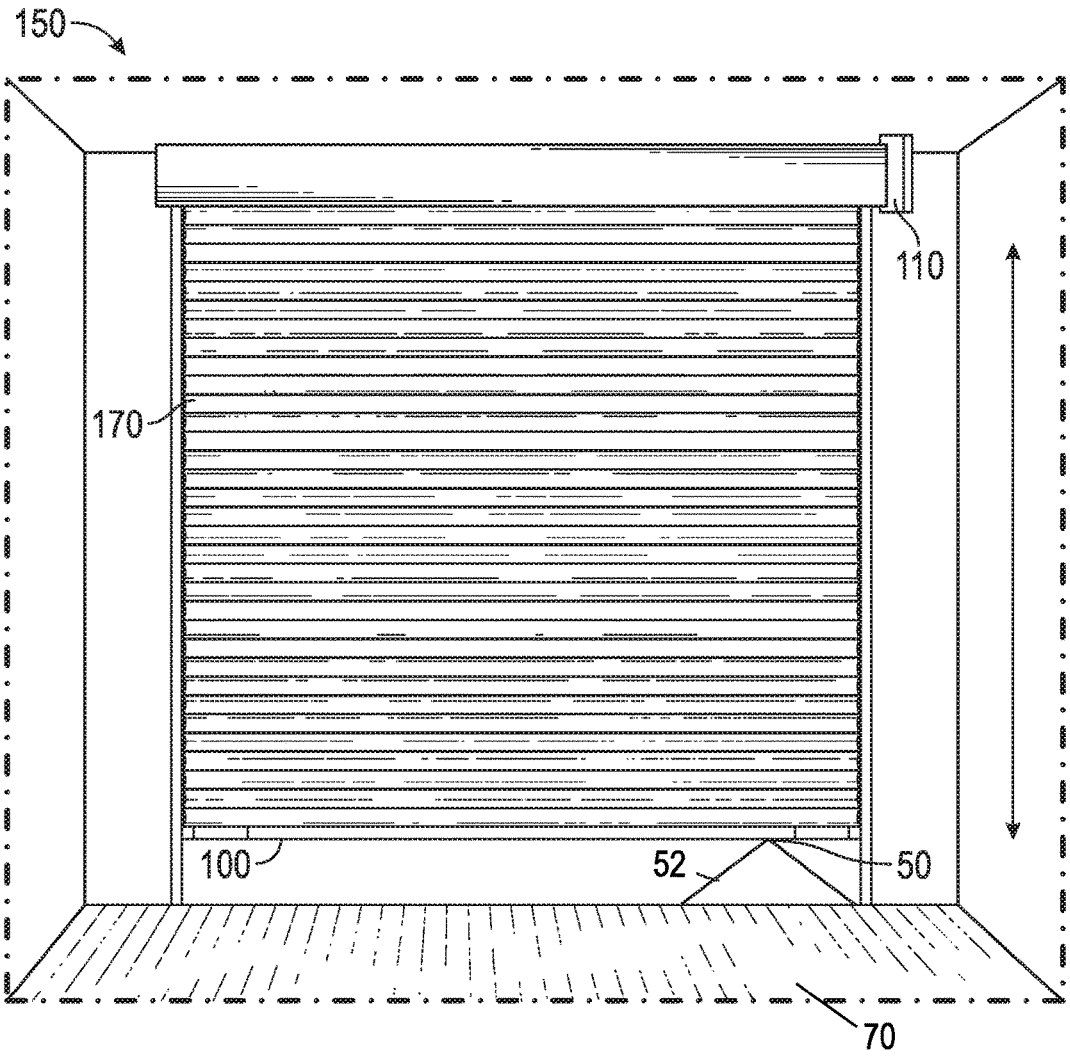
FIG. 1 illustrates an example overhead door having a sensing edge according to an embodiment of the present invention.

Referring to FIG. 1, an example overhead door system 150 having a sensing edge 100, according to an embodiment of the present invention, is illustrated. As shown, the overhead door system 150 includes a motorized gate 170 capable of upward and downward movement (as depicted by the up/down arrows). It is to be understood that the gate 170 will move in an upward direction when opening, and in a downward direction upon closing. It is further to be understood that various different types of motorized overhead doors exist, and the illustrated gate 170 is not meant to be limiting.

In various embodiments, the gate 170 is controlled by a controller 110 operatively coupled to an electric motor operating under the direction of the controller 110. In the illustrated embodiment, the controller 110 and the electric motor are housed together. However, in other embodiments, the controller is situated elsewhere. In some embodiments, the controller 110 is situated near or along the edge 100. The controller can include a "solid state" design or be a programmed PLC, for example. The controller is capable of storing data in storage 114.

Figure 5:
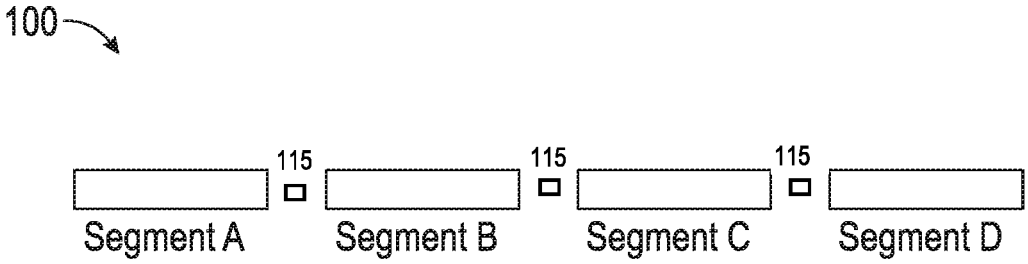
FIG. 5 illustrates a diagram showing that sensing edge divided into a plurality of segments.

In operation, when the gate 170 starts to close it may encounter an obstruction, such as the illustrated obstruction 52. The obstruction 52 could be any object, including a person, situated between the edge 100 and the ground 70 that would interfere with operation of the door system 150. As will be described in greater detail, upon encountering the obstruction 52, the sensing edge 100 senses the obstruction 52 at an impact point 50 and sends a signal to the controller 110 including data interpretable by the controller 110 as to both the existence of an obstruction 52 and a location along the edge 100 of the impact point 50. Although one impact point 50 is shown, it is to be understood that more than one impact point could exist, and the data transmitted to the controller 110 could include data as to the existence and location of additional impact points. Furthermore, it some embodiments, additional sensors, such as optical or thermal sensors 115 (as depicted in FIG. 5) can be included near or along the edge 100 (or elsewhere), and such additional sensor information could be provided to the controller 110, either along with or separately from the tactile sensor data. In the case of a thermal sensor 115, such information could be useful in determining whether a fire exists. A fire door can then be closed, for example. However, if the controller 110 also determines using the tactile sensors that the fire door is obstructed or compromised, the controller 110 can cause the fire door to close incrementally. That is, the door may close a few inches at time and then stop, and repeat until it is fully closed. Alternative circuitry to accomplish this task may be provided. In this manner, a balance is maintained between keeping the fire door closed to limit the spread of the fire and not causing damage or injury, so as to allow a person in the path of or near the door to know that the door is in the process of closing.

Figure 2:
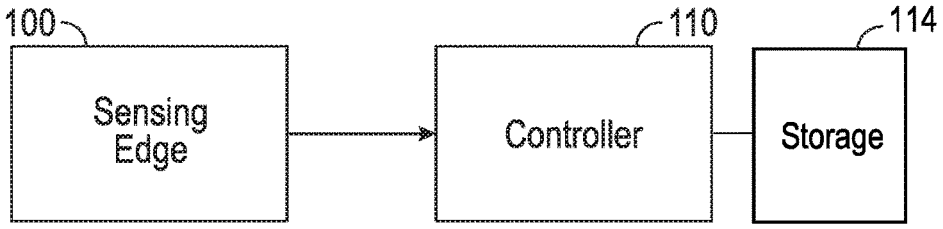
FIG. 2 illustrates a diagram showing the operational linkage between the sensing edge and a control system.

Referring to FIG. 2, a diagram showing the operational linkage between the sensing edge 100 and the controller 110 is provided. It is to be understood that instead of a wired connection between the sensing edge 100 and the controller 110, information can alternatively or additionally be transmitted via a wireless link. For example, in an embodiment, the sensing edge 100 includes a radio transmitter capable of transmitting data to a receiver operatively connected to the controller 110. In other embodiments, the sensing edge 100 includes a transceiver capable of receiving data from the controller 110 as well as transmitting data to the controller 110.

Figure 3:
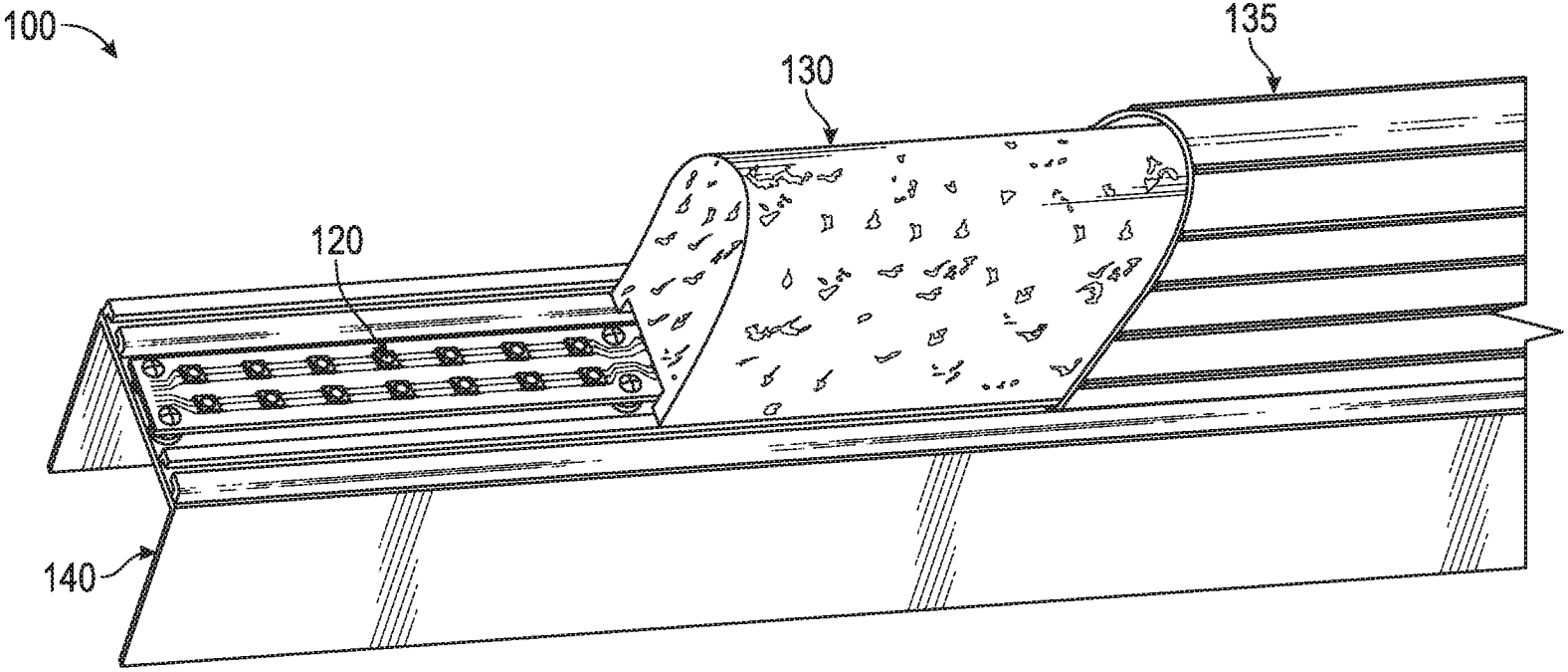
FIG. 3 illustrates a cutaway perspective view of an example sensing edge according to an embodiment of the present invention.

Referring to FIG. 3, a cutaway perspective view of an example sensing edge 100, according to an embodiment of the present invention, is illustrated. As illustrated, the sensing edge 100 includes a retainer 140, a safety board 120, a foam insert 130 and a weather strip 145. The retainer can be made of aluminum or a hard plastic, for example. As shown, the retainer 140 includes a top surface and opposing lateral sides disposed perpendicularly to the top surface forming a C-shaped strip. In an embodiment, the retainer 140 is about $1/8^{th}$ inch in thickness. The length of the retainer 140 can be any suitable size for the door.

It is to be understood that the bottom edge of the gate 170 fits between the pair of lateral sides, and the retainer 140 will be appropriately fastened to the edge of the gate using any suitable means, such as an adhesive, rivets, screws, etc. It is also to be understood that the retainer 140 can run the entire length of the edge. As shown, the safety board 120 is disposed on the top surface of the retainer 140. The safety edge 120 is encapsulated by the weather strip 135, which can be made of vinyl or another durable, flexible and weather-resistant material. The interior is filled with the foam insert 130 which can be a relatively hard foam or another suitable compressible material.

Figure 4:
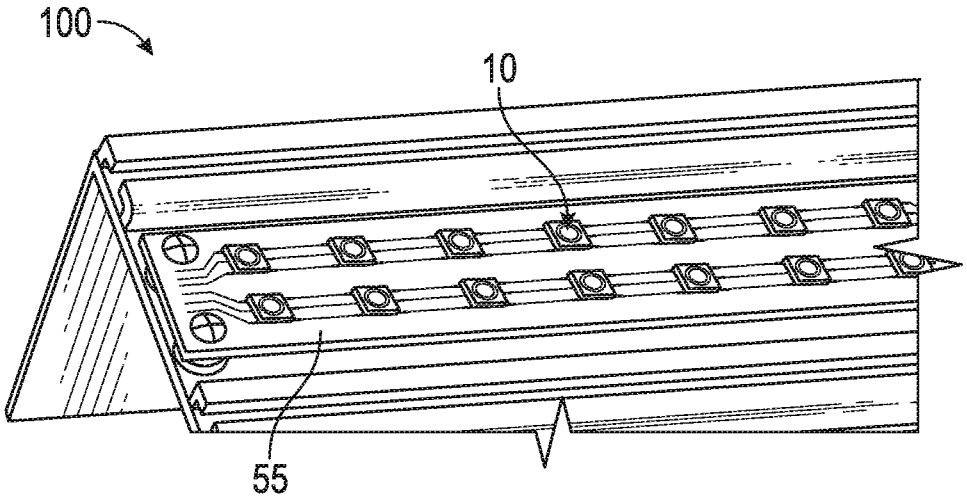
FIG. 4 illustrates a close-up view of the example sensing edge of FIG. 3.

Referring to FIG. 4, a close-up view of the exemplary sensing edge 100 is illustrated. As shown, the safety board 120 includes a substrate 55 that can be a printed circuit board (PCB) or the like running substantially entirely across the length of the edge. Disposed on the substrate 55 is a plurality of tactile sensors 10. Such tactile sensors are activated upon a sufficient force being applied thereto. In operation, when the edge 100 encounters an obstruction, the force from the impact will be transferred through the weather strip 135 and the foam insert 130 to one or more tactile sensor 10. In an embodiment, upon sufficient force, the affected sensors 10 will open a circuit (using "normally closed" sensors). In other embodiments, the force will close a circuit (using "normally open" sensors). In either case, the electrical wiring of the PCB board will be such that the location of the particular sensor 10 or group of sensors 10 can be determined. In the spirit of the invention, the substrate 55 can be achieved alternatively using a flexible circuit board, individual resistive elements, an arrangement of mechanical switches, photo sensors, or any segmental conductive element such as copper or aluminum or breadboard design, etc. Additionally, a trace circuit will preferably be included along the edge and connected to the controller 110. The trace circuit can be a normally closed circuit, and if the door is severely impacted (by an automobile, for example), the trace circuit would be open due to the damage. In this event, a door fault is detected by the controller 110, and the controller 110 would take appropriate action such as instruct the door motor to be shut off. The trace additionally can have an alarm so that if an intruder pries the door open (or attempts to do so) using a crow bar or the like, it would compromise the trace and thus initiate a burglar alarm.

Referring to FIG. 5, the sensing edge 100 is shown divided into addressable segments A-D. It is to be understood that while four segments (A-D) are shown, either a greater or lesser number of segments could be provided. Furthermore, in the illustrated embodiment, each segment is addressable. However, in other embodiments, individual tactile sensors 10 could be addressable.

It is to be understood that each of the segments A-D shown includes a group of contiguous tactile sensors 10 such that when any sensor in the segment is activated, the affected segment can be determined by information sent to the controller 110. In an embodiment, each segment A-D includes fourteen tactile sensors 10 arranged as seven pairs of sensors.

In an embodiment, the segments A-D are electrically isolated. In an embodiment, each Segment A-D can include its own segment transmitter, and each segment transmitter can be operatively coupled to the controller 110. The same effect can be achieved by hard wiring each segment to a single transmitter operatively coupled to the controller 110 or hard wiring each segment to the controller 110. In other embodiments, the segments A-D are connected electrically, but each of the affected segments is individually addressable. In still other embodiments, multiple sensing edges 100 affixed to a plurality of doors are operatively coupled to a single controller 110 that is configured to control each of the doors in case of issues with the doors. In such case, each door would be assigned an identifier and each segment assigned another identifier, according to an agreed upon addressing scheme. In various embodiments, the controller 110 is disposed on the sensing edge 100 (e.g., on the PCB). In other embodiments, the controller 110 is located remotely but operatively coupled to the sensing edge 100.

In various embodiments, the controller 110 includes a CPU that can be configured (e.g., programmed) to take action based on inputs received from the sensing edge 100. The controller 110 could be a programmable logic controller (PLC) or the like, and the inputs could be a sequence of data from the sensing edge 100, for example. Additionally, the controller 110 can include a time/date module to time/date stamp received inputs and record associated actions taken. The controller 110 can further include storage 114 to store this information.

These and other novel elements of the invention will become more apparent from the following examples. However, it is to be understood that the following examples are not meant to be limiting.

Example 1

In normal operation, a motorized door opens and closes in a bottling facility casing room. In a particular instance, the door closes and the sensor edge 100 is activated at Segment D because a bottle crate hits the edge there. In response to Segment D being hit, the controller 110 is configured (e.g., programmed) to halt the operation of a conveyer belt and reverse operation of the door so that the door opens slightly more, and then turn the conveyer back on, allowing the carton to clear the door. Afterwards, the door is closed. Advantageously, the controller can be configured (e.g., programmed) to control a door and other machinery such as the conveyer belt.

Example 2

In normal operation a door opens and closes in an automated assembly line. During operation, it is not unusual for there to be an obstruction along the middle edge segments B-C but obstructions along outer edge segments A and D indicates a serious problem. The controller 110 can be configured to open the door slightly more when the inner segments are activated but entirely shut the system down if any outer segment is activated.

Example 3

During litigation over an injury allegedly caused by a faulty motorized door, the plaintiff or a witness may claim certain facts that are verifiable through analysis of collected data from the edge 100. In this case, the data can be time stamped and recorded for later use. The sequence of door operations, including the location of any impacts along the door, can be determined. The height of the door can be determined given the known rate of closure speed, the time between start of closing and the time of the obstruction event, etc.

Example 4

During litigation over property damage allegedly caused by a barrier arm hitting a car in a parking facility, it is determined that the damage to the car is consistent only with the middle portion of the barrier striking the windshield. Using collected and time-stamped data from an edge attached to the barrier arm, the accident can be reconstructed and the claim verified.

Example 5

Upon a proper initial installation of a door, it is determined that 10% of the tactile sensors are activated when the door is closed. However, over time it is noted that when the door is closed, 30% of the sensors are activated indicating that the door is hitting the ground harder than necessary. In this case, a mechanic can be sent to inspect the door, or the door can be rendered to a stop state and/or operation which requires an end user to be in full site of operation until door problem is remedied.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A safety edge system, comprising a safety edge including a printed circuit board, a weather strip and an insert;

a plurality of tactile sensors arranged longitudinally across the printed circuit board and embedded thereon, the weather strip encapsulating the tactile sensors and the printed circuit board, and the insert filling an interior space between the sensors and the weather strip;

a controller operatively connected to the tactile sensors, wherein, responsive to application of a force through the weather strip and the insert of the safety edge, the controller is able to identify a location along the length of the safety edge where the force was applied using data provided from the tactile sensors, and wherein the controller time stamps data regarding operation of the safety edge and the time stamped data is stored on a storage medium.

2. The safety edge system of claim 1, wherein the safety edge is capable of attachment to an edge of a motorized gate.

3. The safety edge system of claim 1, wherein the sensors are grouped into sectors, each sector separately identifiable.

4. The safety edge system of claim 1, wherein the sensors include one or more of individual resistive elements, an arrangement of mechanical switches, photo sensors, and a segmental conductive element.

5. The safety edge system of claim 1, wherein the controller causes at least one gate to incrementally close when at least one thermal sensor is activated and an obstruction is detected based upon data received from one or more of the tactile sensors.

6. The safety edge system of claim 1, wherein the printed circuit board includes a closed circuit, and when force is applied to one or more of the tactile sensors electrically connected to the circuit, the circuit is opened thereby signaling a fault.

7. The safety edge system of claim 1, wherein the printed circuit board includes a open circuit, and when force is applied to one or more of the tactile sensors electrically connected to the circuit, the circuit is closed thereby signaling a fault.

* * * * *